United States Patent [19]

Rehder

[11] Patent Number: 4,722,356

[45] Date of Patent: Feb. 2, 1988

[54] KNEE PAD ATTACHMENT FOR INVALID WALKER

[76] Inventor: Carol C. Rehder, 214 S. Hazelwood, Davenport, Iowa 52802

[21] Appl. No.: 904,584

[22] Filed: Sep. 8, 1986

[51] Int. Cl.[4] ..... A61H 3/00

[52] U.S. Cl. ..... 135/67; 272/70; 272/70.4; 297/5; 297/423

[58] Field of Search ..... 135/67, 69; 2/24; 182/120, 121, 132; 248/235, 225.31, 415, 425; 5/443, 431; 269/322, 328; 272/144, 146, 70.3, 70.4; 297/423, 429, 430, 431, 432; 403/49

[56] References Cited

U.S. PATENT DOCUMENTS

| | | | |
|---|---|---|---|
| 78,472 | 6/1868 | Neuhaus | 297/431 |
| 2,258,920 | 10/1941 | Yates | 132/41 C |
| 2,391,284 | 12/1945 | Weiss | 132/42 R |
| 2,897,013 | 7/1959 | Delp | 182/132 |
| 3,046,072 | 7/1962 | Douglass, Jr. et al. | 269/328 |
| 3,392,801 | 7/1968 | Gethmann | 182/132 |
| 3,461,884 | 8/1969 | Augusta | 132/42 R |
| 3,596,668 | 7/1971 | Tosto | 135/67 |
| 4,004,393 | 1/1977 | Morris | 403/49 |
| 4,381,791 | 5/1983 | Van Sickle | 132/40 |
| 4,449,750 | 5/1984 | Pultman | 135/67 |

FOREIGN PATENT DOCUMENTS

| | | | |
|---|---|---|---|
| 1033585 | 7/1953 | France | 132/42 R |
| 1368924 | 6/1964 | France | 132/42 R |
| 6220 | of 1896 | United Kingdom | 132/43 R |

*Primary Examiner*—Robert A. Hafer
*Assistant Examiner*—Charles H. Sam
*Attorney, Agent, or Firm*—Henderson & Sturm

[57] ABSTRACT

An attachment for an invalid walker that provides an adjustable padded support for the user's knee. The attachment has easily adapted hook elements for ready attachment to and detachment from conventional walkers. Provision is made for both vertical and angular position selectivity, and the support for the pad enables reversal of the pad supporting post so as to increase the versatility of the attachment.

11 Claims, 7 Drawing Figures

KNEE PAD ATTACHMENT FOR INVALID WALKER

BACKGROUND AND SUMMARY OF THE INVENTION

Knee pads and equivalent supports are known as parts of or attachments for invalid walkers, typical of which is that disclosed in the U.S. Pat. No. 3,596,668, to Tosto. The Tosto device is a simple, removable, padded tray-like element that hooks over the front lower cross bar of the walker as well as hooking over a lower fore-and-aft bar of the walker. The Tosto pad must be made in right or left models according to which knee is to be supported and is provided with hook-over portions, depending upon whether the right or left fore-and-aft bar is used in conjunction with the cross bar in front, but in either case the level or elevation of the pad remains the same, the adjustment being basically to accommodate either the right or left knee.

According to the present invention, several positions of the knee pad are available, including a number of vertical positions as well as a number of lateral positions resulting from swingability of the pad from left to right about a vertical axis. Further positions are available in a fore-and-aft direction. Additionally, the support for the pad includes cooperative means enabling reversibility, end for end, of a pad-supporting post, thereby resulting in a still wider range of adjustment. The attachment features simple design, yielding a sturdy, low-cost product that may be inexpensively manufactured, distributed, and used, adding to the improved care of invalided persons.

The foregoing and other important features and advantages of the invention will become apparent as a preferred embodiment thereof is disclosed in the ensuing description and accompanying drawings.

DETAILED DESCRIPTION OF A PREFERRED EMBODIMENT OF THE INVENITON

Figure 1:
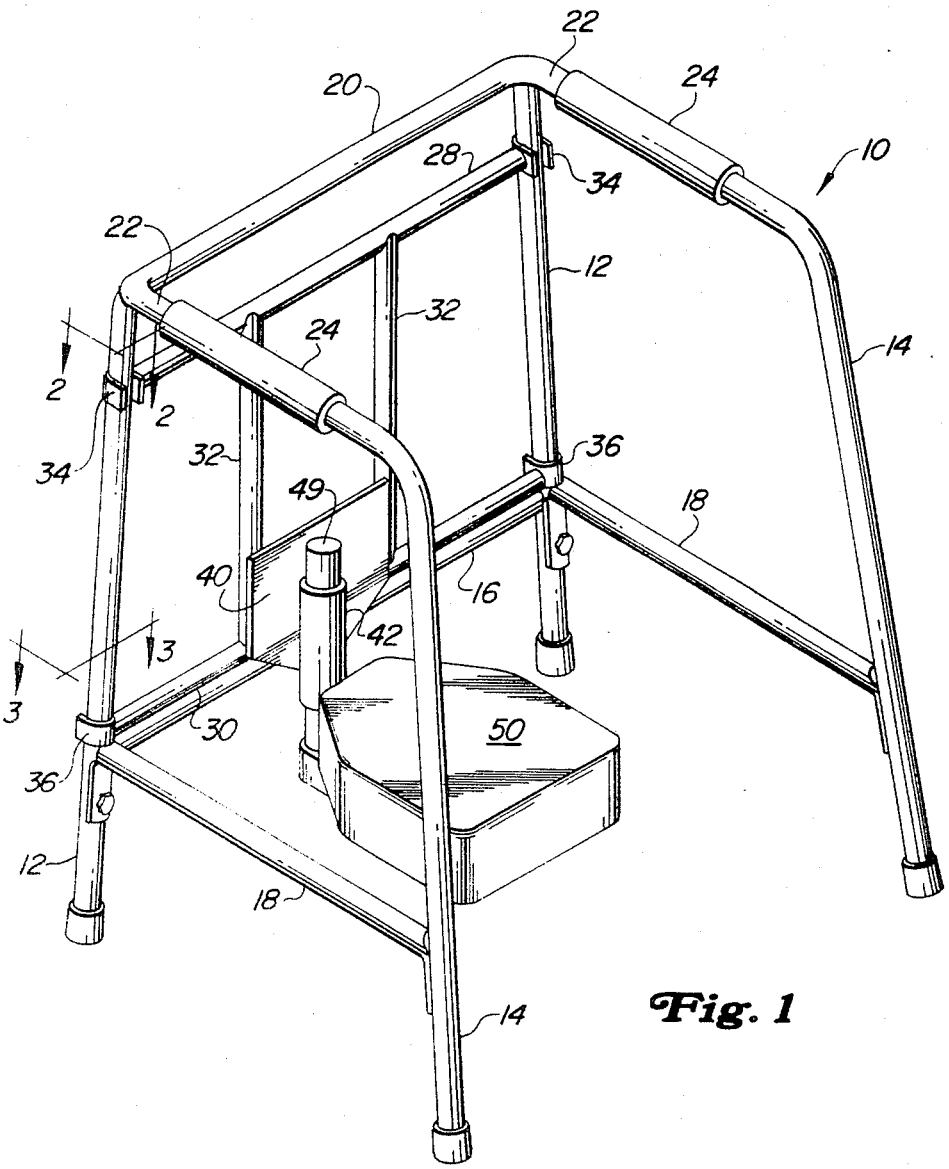
FIG. 1 is a small-scale perspective showing the attachment in use with a known type of walker.

The numeral (10) in FIG. 1 denotes a typical invalid walker having a pair of front legs (12), a pair of rear legs (14), a lower front cross bar or brace (16) and right and left fore-and-aft bars or braces (18). The rear legs are part of a U-shaped tubular part including a bight (20) that provides a top cross bar and top fore-and-aft arms (22) that are fitted with pads (24). The terms "front", "rear", etc. are used with respect to the parts as seen by a user patient facing forwardly in the walker.

Figure 2:
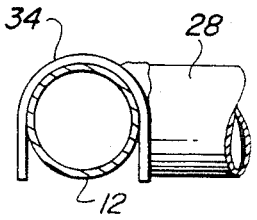
FIG. 2 is an enlarged section on the line 2—2 of FIG. 1.
Figure 3:
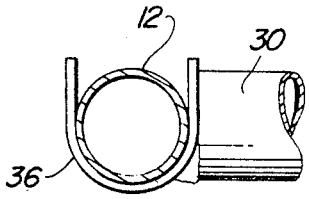
FIG. 3 is an enlarged section on the line 3—3 of FIG. 1.

The attachment, designated as a whole by the numeral (26), is preferably constructed of metal tubing or the like having high strength and low weight and here comprises upper and lower cross members (28) and (30) that are rigidly connected to the tops and bottoms of a pair of upright members (32). Each end of the top member is provided with attachment means in the form of a U-shaped element or hook (34) shaped to hook over and engage the associated front leg from the front (FIG. 2), the areas of engagement in this respect being at upper portions of the front legs. Likewise, but reversed, each end of the lower cross member has a hook-like element (36) adapted to hook over and engage the associated front leg from the rear, the engagement here being just above the walker lower cross bar (16) (FIGS. 1 and 3). Each hook element may be configured to have a frictional or like fit with its associated leg portion, as by being formed of springy material. As will be seen from the description to follow, the manner of support of the attachment on the walker, utilizing the hook elements (34) and (36) and engagement with the lower walker cross bar enables easy mounting of the attachment on and removal thereof from the walker, and also accommodates any overturning moment resulting from the weight of the walker user.

Figure 4:
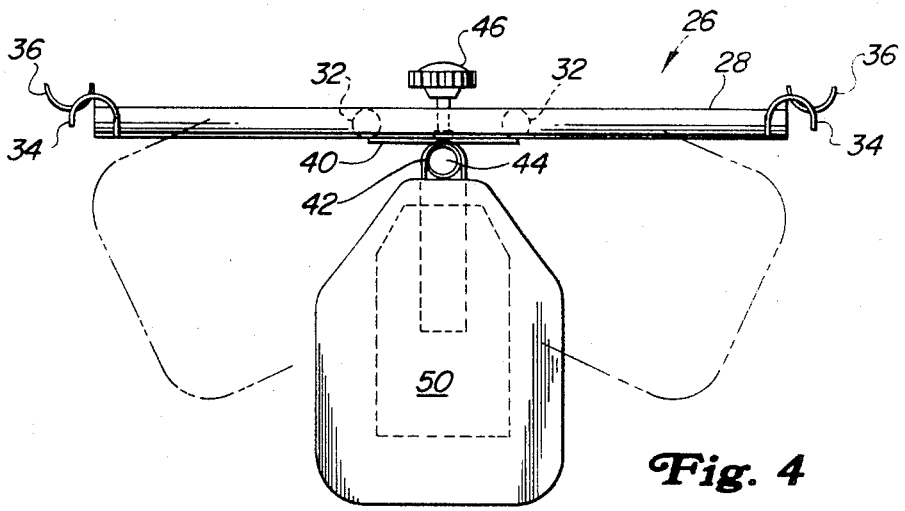
FIG. 4 is an enlarged plan of the attachment per se, the dotted lines showing representative adjusted positions of the pad.
Figure 5:
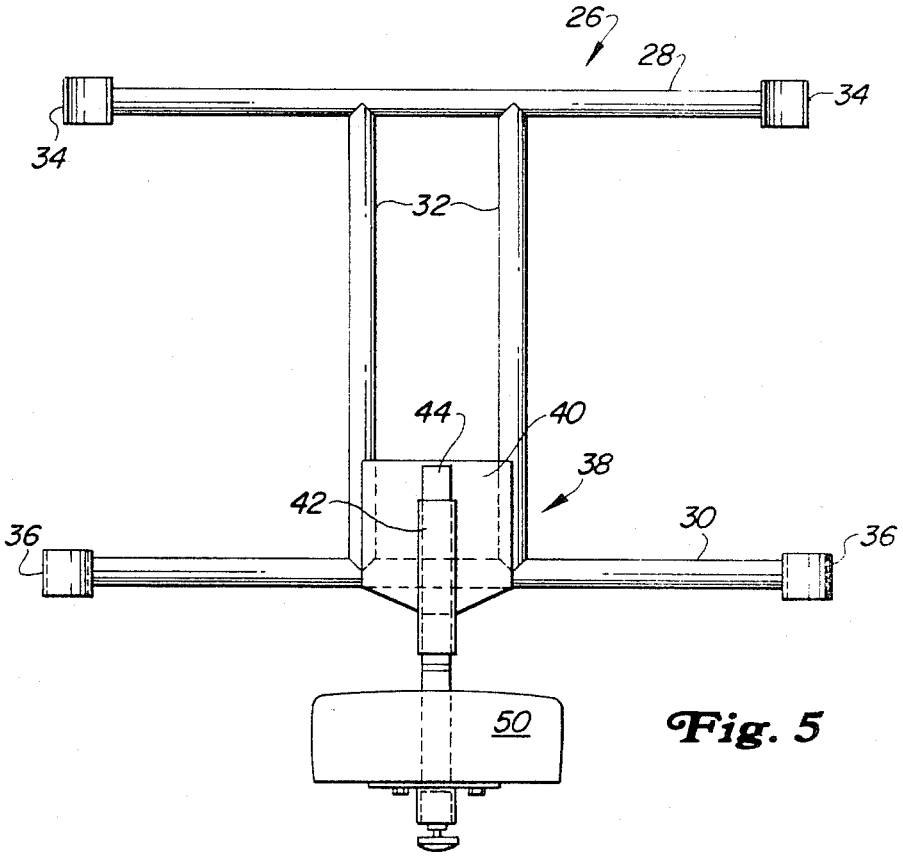
FIG. 5 is a face view of the attachment as seen from the rear or patient's side of the walker.

In addition to the framework established by the uniting of the attachment members (28), (30), and (32), the attachment includes a substantially central support means (38) comprising a metal plate (40) affixed to the members (30) and (32) and a tube (42) fixed to the plate and providing a bearing on a vertical axis. The tube receives a post (44) of cylindrical section so that the post is both slidably and angularly movable in the tube. Both vertical and angular adjustments of the post are thus available, and selective positions are maintained by means including a hand screw (46). See FIGS. 4, 6, and 7, FIG. 4 showing, in dotted lines, angular positions and FIGS. 6 and 7 showing end-for-end reversibility of the post in the tube (42) which is of course open at both its upper and lower ends.

Figure 7:
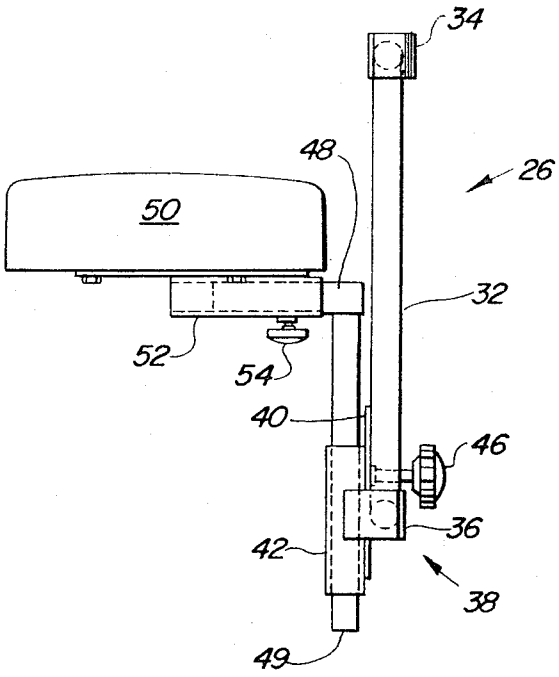
FIG. 7 is a similar view but showing the post reversed and the pad turned to occupy a second adjusted mode.
Figure 6:
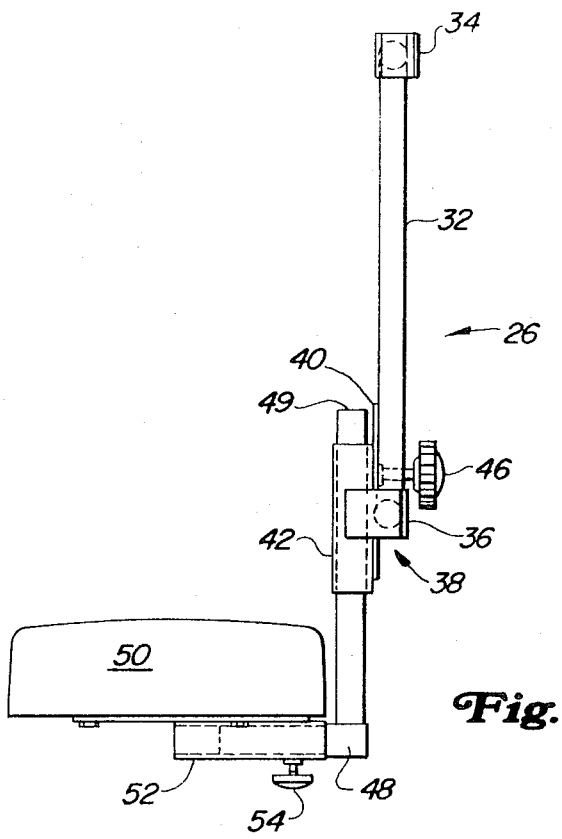
FIG. 6 is a side view, showing one mode of post positioning.

One end of the post has rigid therewith a horizontal arm (48), preferably of square section, and serves as a part of means mounting a knee pad (50) which has a square-sectioned sleeve (52) at its underside dimensioned to slidably fit the arm so as to enable fore-and-aft adjustment of the pad as well as removal and inversion of the pad when the post is reversed end-for-end as between FIGS. 6 and 7. A hand screw (54) is provided for securing the selected position of the pad.

In use, the attachment is mounted on the typical walker via the hook elements (34) and (36) and the pad is positioned as to height and lateral position; i.e., left or right or any selected positions in between, according to the stature of the user. In the present case, the angular range of swinging of the pad is in the order of 140°. The grasping nature of the hooks on the respective leg portions retains the attachment in place against inadvertent dislodging, yet the attachment is easily removable when the occasion arises. When vertical adjustment of the pad entails inversion of the post, as between the positions of FIGS. 6 and 7, the pad is removed from the arm and remounted in its inverted position so as to keep the knee-supporting surface on top.

Features and advantages other than those pointed out herein will become apparent to those versed in the art, as will many modifications and alterations in the preferred embodiment disclosed, all of which may be achieved without departure from the spirit and scope of the invention.

I claim:

1. A knee pad attachment for use with an invalid walker of the type including a pair of front legs, a pair of rear legs and a horizontal cross bar spanning and interconnecting the front legs and spaced above the ground level on which the walker is used, the improvement residing in an adjustable knee-bearing attachment comprising bracket means having vertically spaced upper and lower attaching means for engaging vertically spaced apart portions of the front legs, a support fixed to the bracket means and providing a bearing on a vertical axis, a post vertically slidably received in the bearing, a knee pad carried by the post, and means cooperative between the post and support for selectively fixing the elevated position of the post.

2. The improvement according to claim 1, in which the post is also angularly adjustable about the axis of the bearing means and the means cooperative between the post and support also serves to fix the post in selected angular positions.

3. The improvement according to claim 1, including a horizontal arm rigid with one end of the post and projecting rearwardly from the post and the knee pad is mounted on the arm.

4. The improvement according to claim 3, in which the post is selectively invertable in the bearing to dispose the arm in either an upper position or a lower position, and the pad is selectively invertable on the arm so as to dispose the upper surface of the pad upwardly in either position of the post.

5. The improvement according to claim 4, in which the arm is of non-circular section and the pad has sleeve of like section slidably fitting the arm for enabling inversion of the pad.

6. The improvement according to claim 1, in which the upper attachment means includes hook-like elements for engaging and hooking around the front legs from the front and the lower attachment means includes hook-like elements for engaging and hooking around the front legs from the rear.

7. The improvement according to claim 6, in which the bracket means further engages the horizontal bar.

8. The improvement according to claim 1, in which the bracket comprises a pair of laterally spaced apart, upright members, the upper and lower attaching means comprise, respectively, upper and lower cross members rigidly cross-connecting the upright members and the post support means spans and interconnects the upright members intermediate the upper and lower cross members.

9. The improvement according to claim 8, in which the upper attaching means comprises elements respectively at opposite ends of the upper cross member and respectively engaging the front legs of the walker, and the lower attaching means comprises elements respectively at opposite ends of the lower cross member and respectively engaging the front legs of the walker.

10. The improvement according to claim 9, in which the upper elements hook around the front legs from the front and the lower elements hook around the front legs from the rear.

11. The improvement according to claim 1, in which the support means is open at its upper and lower ends and the post is reversible end for end for selective insertion into the upper or lower end of the support means.

* * * * *